US009179738B2

(12) United States Patent
Rustam et al.

(10) Patent No.: US 9,179,738 B2
(45) Date of Patent: Nov. 10, 2015

(54) GOLF SHOES

(71) Applicant: Taylor Made Golf Company, Inc., Carlsbad, CA (US)

(72) Inventors: Ernie Rustam, Oceanside, CA (US); Marco Aurelio Grott, San Marcos, CA (US); June Cate, Chula Vista, CA (US); Gerald Kuhtz, Nuremberg (DE)

(73) Assignee: Taylor Made Golf Company, Inc., Carlsbad, CA (US)

( * ) Notice: Subject to any disclaimer, the term of this patent is extended or adjusted under 35 U.S.C. 154(b) by 305 days.

(21) Appl. No.: 13/866,928

(22) Filed: Apr. 19, 2013

(65) Prior Publication Data

US 2014/0123522 A1 May 8, 2014

Related U.S. Application Data

(60) Provisional application No. 61/722,520, filed on Nov. 5, 2012.

(51) Int. Cl.

| | |
|---|---|
| ***A43B 5/00*** | (2006.01) |
| ***A43B 13/22*** | (2006.01) |
| ***A43C 15/16*** | (2006.01) |
| ***A43C 13/04*** | (2006.01) |
| ***A43B 7/14*** | (2006.01) |
| ***A43B 13/12*** | (2006.01) |
| ***A43B 13/16*** | (2006.01) |

(52) U.S. Cl.

CPC ..... *A43B 13/22* (2013.01); *A43B 5/001* (2013.01); *A43B 7/144* (2013.01); *A43B 7/145* (2013.01); *A43B 7/1425* (2013.01); *A43B 7/1435* (2013.01); *A43B 7/1445* (2013.01); *A43B 13/122* (2013.01); *A43B 13/16* (2013.01); *A43B 13/223* (2013.01); *A43C 13/04* (2013.01); *A43C 15/16* (2013.01)

(58) Field of Classification Search

CPC ..... A34B 5/00; A34B 5/001; A43C 13/04; A43C 15/00; A43C 15/16

USPC ..... 36/126–129, 134, 59 R, 59 C, 67 R, 102, 36/114, 88, 94

See application file for complete search history.

(56) References Cited

U.S. PATENT DOCUMENTS

| | | | | |
|---|---|---|---|---|
| 3,818,617 | A * | 6/1974 | Dassler et al. | 36/32 R |
| 4,067,123 | A * | 1/1978 | Minihane | 36/32 R |

(Continued)

OTHER PUBLICATIONS

Screen Shot from website www.truelinkswear.com, printed Jun. 28, 2012 (1 page).

*Primary Examiner* — Marie Bays

(74) *Attorney, Agent, or Firm* — Klarquist Sparkman, LLP

(57) ABSTRACT

Disclosed golf shoes can include an upper and an outsole, and an oblique internal toe box region defined between a forward portion of the upper and a forward portion of the outsole. The toe box region can have a shape that corresponds to an anatomical shape of a forward portion of a person's foot. The forward portion of the outsole can have five discrete toe traction zones each being configured to be positioned below a respective one of a person's toes. The toe box region can be sufficiently wide to allow a wearer's toes to have a full anatomical range of motion in medial and lateral directions. The toe box region can be sufficiently wide such that the ratio of a maximum width of the toe box region divided by a maximum heel-to-toe length of an internal open region of the golf shoe is greater than about 0.35.

13 Claims, 10 Drawing Sheets

(56) References Cited

U.S. PATENT DOCUMENTS

| | | | | |
|---|---|---|---|---|
| 4,562,651 | A * | 1/1986 | Frederick et al. | 36/102 |
| D292,443 | S | 10/1987 | Ihlenburg | |
| D347,105 | S | 5/1994 | Johnson | |
| 5,371,957 | A | 12/1994 | Gaudio | |
| 5,384,973 | A * | 1/1995 | Lyden | 36/25 R |
| D380,889 | S | 7/1997 | Earle | |
| D390,347 | S | 2/1998 | Bathum | |
| D390,349 | S | 2/1998 | Murai et al. | |
| D401,747 | S | 12/1998 | Cessor | |
| D406,689 | S | 3/1999 | Murcia | |
| 5,943,794 | A * | 8/1999 | Gelsomini | 36/127 |
| 6,016,613 | A * | 1/2000 | Campbell et al. | 36/59 C |
| 6,018,893 | A * | 2/2000 | Workman | 36/134 |
| 6,119,373 | A | 9/2000 | Gebhard et al. | |
| D440,749 | S | 4/2001 | Rogers | |
| 6,237,251 | B1 | 5/2001 | Litchfield et al. | |
| D475,509 | S | 6/2003 | Avar | |
| 6,701,642 | B2 * | 3/2004 | Hay | 36/59 C |
| D495,479 | S | 9/2004 | McDowell | |
| D496,778 | S | 10/2004 | Le | |
| D507,097 | S | 7/2005 | Sonnergren | |
| D509,948 | S | 9/2005 | Robinson, Jr. et al. | |
| D515,290 | S | 2/2006 | Sonnergren | |
| D539,515 | S | 4/2007 | Robinson, Jr. et al. | |
| D543,679 | S | 6/2007 | Edwards | |
| D548,440 | S | 8/2007 | Ortley et al. | |
| D551,433 | S | 9/2007 | Loverin | |
| D560,885 | S | 2/2008 | Lane et al. | |
| D564,198 | S | 3/2008 | Kuhtz | |
| D567,490 | S | 4/2008 | Campbell et al. | |
| 7,392,604 | B2 | 7/2008 | Greene et al. | |
| D578,286 | S | 10/2008 | Hogan | |
| D580,136 | S | 11/2008 | St-Louis et al. | |
| D581,146 | S | 11/2008 | Lane, III | |
| D586,989 | S | 2/2009 | Dave et al. | |
| D587,441 | S | 3/2009 | Lane, III et al. | |
| D593,736 | S | 6/2009 | Mochen et al. | |
| D593,738 | S | 6/2009 | McClaskie | |
| D595,945 | S | 7/2009 | Mochen | |
| D601,785 | S | 10/2009 | Lane, III et al. | |
| 7,610,695 | B2 * | 11/2009 | Hay | 36/25 R |
| D607,635 | S | 1/2010 | Lane, III et al. | |
| D608,081 | S | 1/2010 | Bacon et al. | |
| D609,893 | S | 2/2010 | Kuhtz | |
| 7,685,745 | B2 | 3/2010 | Kuhtz et al. | |
| D631,234 | S | 1/2011 | Kasprzak | |
| D632,466 | S | 2/2011 | Kasprzak | |
| 7,905,034 | B2 | 3/2011 | Robinson, Jr. et al. | |
| D636,157 | S | 4/2011 | Nascimento | |
| 8,099,880 | B2 | 1/2012 | Brewer et al. | |
| D654,680 | S | 2/2012 | Mochen | |
| D658,868 | S * | 5/2012 | Chenciner | D2/972 |
| D661,075 | S | 6/2012 | Bacon et al. | |
| D663,934 | S | 7/2012 | Bacon | |
| D664,344 | S | 7/2012 | Bacon et al. | |
| D667,204 | S | 9/2012 | Campbell et al. | |
| D667,205 | S | 9/2012 | Campbell et al. | |
| 8,286,371 | B2 | 10/2012 | Baker et al. | |
| D670,490 | S | 11/2012 | McClaskie | |
| D671,726 | S | 12/2012 | Petrie | |
| 8,356,428 | B2 | 1/2013 | Auger et al. | |
| 8,516,721 | B2 * | 8/2013 | Mahoney | 36/50.1 |
| 2002/0166263 | A1 * | 11/2002 | Sink | 36/127 |
| 2006/0213088 | A1 | 9/2006 | Grove et al. | |
| 2007/0144039 | A1 * | 6/2007 | Fliri | 36/94 |
| 2007/0199211 | A1 * | 8/2007 | Campbell | 36/59 R |
| 2007/0199213 | A1 * | 8/2007 | Campbell et al. | 36/102 |
| 2010/0139129 | A1 | 6/2010 | Kuhtz et al. | |
| 2010/0257751 | A1 | 10/2010 | Burt et al. | |
| 2011/0146108 | A1 | 6/2011 | Grott et al. | |
| 2012/0233887 | A1 | 9/2012 | Baker et al. | |
| 2013/0118031 | A1 * | 5/2013 | Chenciner | 36/88 |
| 2013/0152428 | A1 * | 6/2013 | Bishop et al. | 36/103 |
| 2013/0232820 | A1 * | 9/2013 | Bramani | 36/94 |
| 2014/0182169 | A1 * | 7/2014 | Mack | 36/102 |

* cited by examiner

GOLF SHOES

CROSS REFERENCE TO RELATED APPLICATION

This application claims the benefit of U.S. Provisional Patent Application No. 61/722,520, filed Nov. 5, 2012, which is incorporated herein by reference in its entirety.

FIELD

This disclosure relates to golf shoes.

BACKGROUND

Golf shoes play an important role during a golfer's swing. A golf shoe supports the golfer's foot while allowing the golfer's foot to transfer forces between the golfer's body and the ground. The golfer's footwork is important to the execution of a proper and effective golf swing.

The golfer's footwork during the swing is nuanced and differs from left foot to right foot. In general, for most golf shots the golfer's weight is initially distributed 50/50 on each foot and the weight is centered in the middle of each foot. During the backswing, the golfer's weight should shift to the outside (lateral side) of the golfer's back foot while the front foot maintains some weight for balance. The backswing applies forces tending to spin or pivot the back forefoot outwardly and the back heel inwardly, which must be resisted by the back foot's contact with the ground to keep the golfer's back foot stable. During the downswing of the club, the golfer's weight begins to shift and by the time the golf ball is struck, the golfer's weight is evenly balanced on the rear foot and front foot or has started to shift more to the front foot. At the finish position of the swing, most of the golfer's weight is on the front foot with more weight on the outside (lateral side) of the front foot than the inside (medial side), and the golfer's heel and shoe outsole are elevated above the ground and facing rearwardly. In a proper swing, only the toe of the golfer's rear foot remains in contact with the ground at the finish. In the finish position, the heel and most of the outsole of the golfer's rear shoe are off of the ground, with only the toe contacting the ground for balance. During the swing, the golfer's foot makes complex movements to keep the golfer balanced while generating torque.

SUMMARY

Some embodiments of a golf shoe comprise an upper and an outsole, and an oblique internal toe box region defined between a forward portion of the upper and a forward portion of the outsole. The toe box region has a shape that corresponds to an anatomical shape of a forward portion of a person's foot. In some embodiments, the forward portion of the outsole comprises five discrete toe traction zones each being configured to be positioned below a respective one of a person's toes when the golf shoe is worn on the person's foot. In some embodiments, the toe box region is sufficiently wide to allow a wearer's toes to have a full anatomical range of motion in medial and lateral directions. In some embodiments, the toe box region corresponds to a shape of a barefoot last rather than a stylized last more akin to a men's dress shoe. In some embodiments, the toe box region is sufficiently wide such that the ratio of a maximum width of the toe box region divided by a maximum heel-to-toe length of an internal open region of the golf shoe is greater than 0.35.

Some embodiments of golf shoes disclosed herein comprise an outsole having a toe region that includes a plurality of toe traction zones separated from one another by a plurality of toe channels that extend in a heel-toe direction, the toe traction zones being configured to be positioned under respective toes of the wearer's foot. In some embodiments, the toe region comprises five toe traction zones and four toe channels, each of the toe traction zones being configured to be positioned under a respective one of five toes of the person's foot. Each toe traction zone can comprise two or more cleats, such as static lug type cleats.

In some embodiments, a midfoot region of the outsole comprises a midfoot traction zone that is separated from the toe traction zones by a lateral channel that extends side-to-side across the outsole from a medial side of the outsole to a lateral side of the outsole.

In some embodiments, each of the toe traction zones comprises a toe base pad and at least one cleat. The toe base pads and the toe channels can extend around a front end of the golf shoe and can be visible from a top-down view of the golf shoe when the show is resting on a flat surface.

Some embodiments of a golf shoe outsole comprises a heel region, an arch region forward of the heel region, and a forefoot region forward of the arch region, wherein the forefoot region comprises a cross channel extending across the outsole from a medial side of the forefoot region to a lateral side of the forefoot region and the forefoot region also comprises four longitudinal channels extending across the forefoot region from the arch region to a front end of the outsole such that the longitudinal channels intersect the cross channel.

Some of these embodiments further comprise two additional cross channels extending across the outsole from the medial side of the forefoot region to the lateral side of the forefoot region such that the two additional cross channels also intersect the longitudinal channels.

In some embodiments, the cross channel comprises recessed cavities at intersections of the cross channel with the longitudinal channels and the recessed cavities are recessed deeper into the outsole than a remainder the cross channel.

In some embodiments, the four longitudinal channels divide the forefoot into five forefoot traction portions and each of the five forefoot traction portions is configured to be positioned generally under a respective one of a person's metatarsals.

In some embodiments, the forefoot region further comprises five toe traction portions positioned forward of the cross channel and separated from one another by the four longitudinal channels.

Some embodiments further comprise two additional cross channels extending across the outsole from the medial side of the forefoot region to the lateral side of the forefoot region such that the two additional cross channels also intersect the longitudinal channels.

Some embodiments of a golf shoe outsole comprise a heel region that comprises an outer group of cleats arranged around a perimeter of the heel region, an inner group of cleats arranged within the outer group of cleats, and an intermediate group of cleats arranged within the outer group of cleats and around the inner group of cleats. In some embodiments, the perimeter of the heel region is rounded in a horizontal plane and rounded in vertical planes such that the outer group of cleats project from the rounded perimeter in both radially outward and downward directions.

In some embodiments, the outer group of cleats are aligned along a curvilinear path that extends around medial, rear, and lateral sides of the heel region, and in some embodiments, the intermediate group of cleats are aligned along a curvilinear path that extends around medial, rear, and lateral sides of the inner group of cleats.

The foregoing and other objects, features, and advantages of the invention will become more apparent from the following detailed description, which proceeds with reference to the accompanying figures.

DETAILED DESCRIPTION

The following description is exemplary in nature and is not intended to limit the scope, applicability, or configuration of the disclosed embodiments in any way. Various changes to the described embodiments may be made in the function and arrangement of the elements described herein without departing from the scope of the disclosure.

Figure 1:
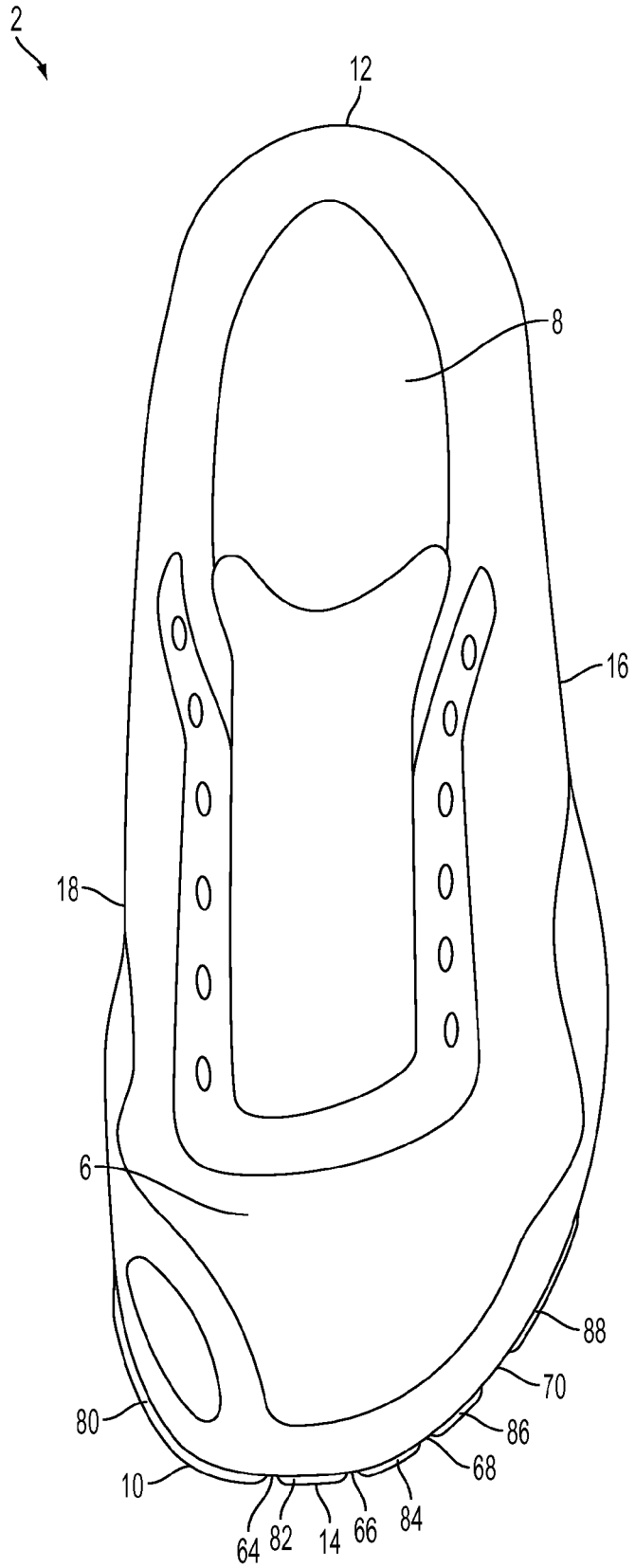
FIG. 1 is a top view of an exemplary golf shoe.
Figure 2:
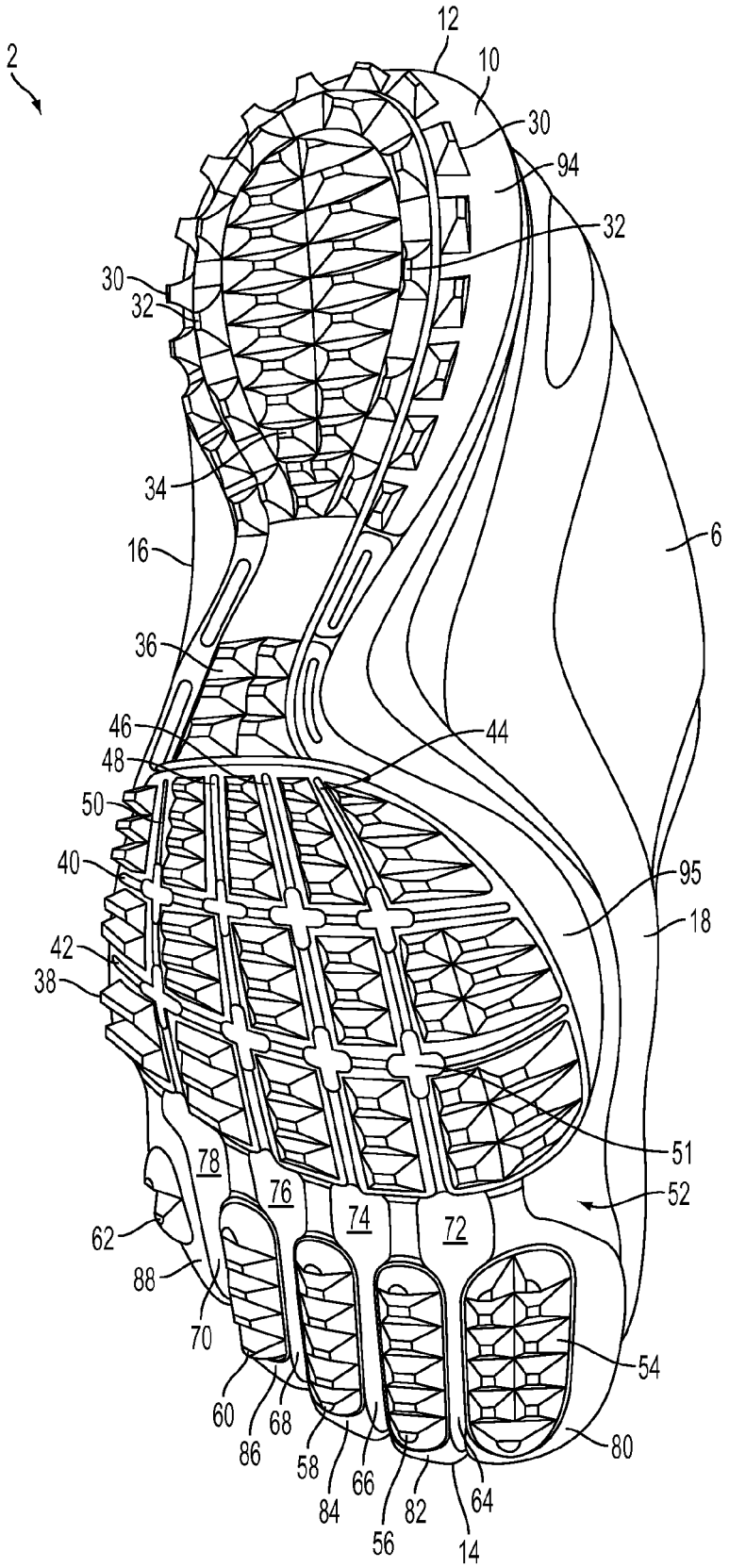
FIG. 2 is a medial-bottom perspective view of the golf shoe of FIG. 1.
Figure 3:
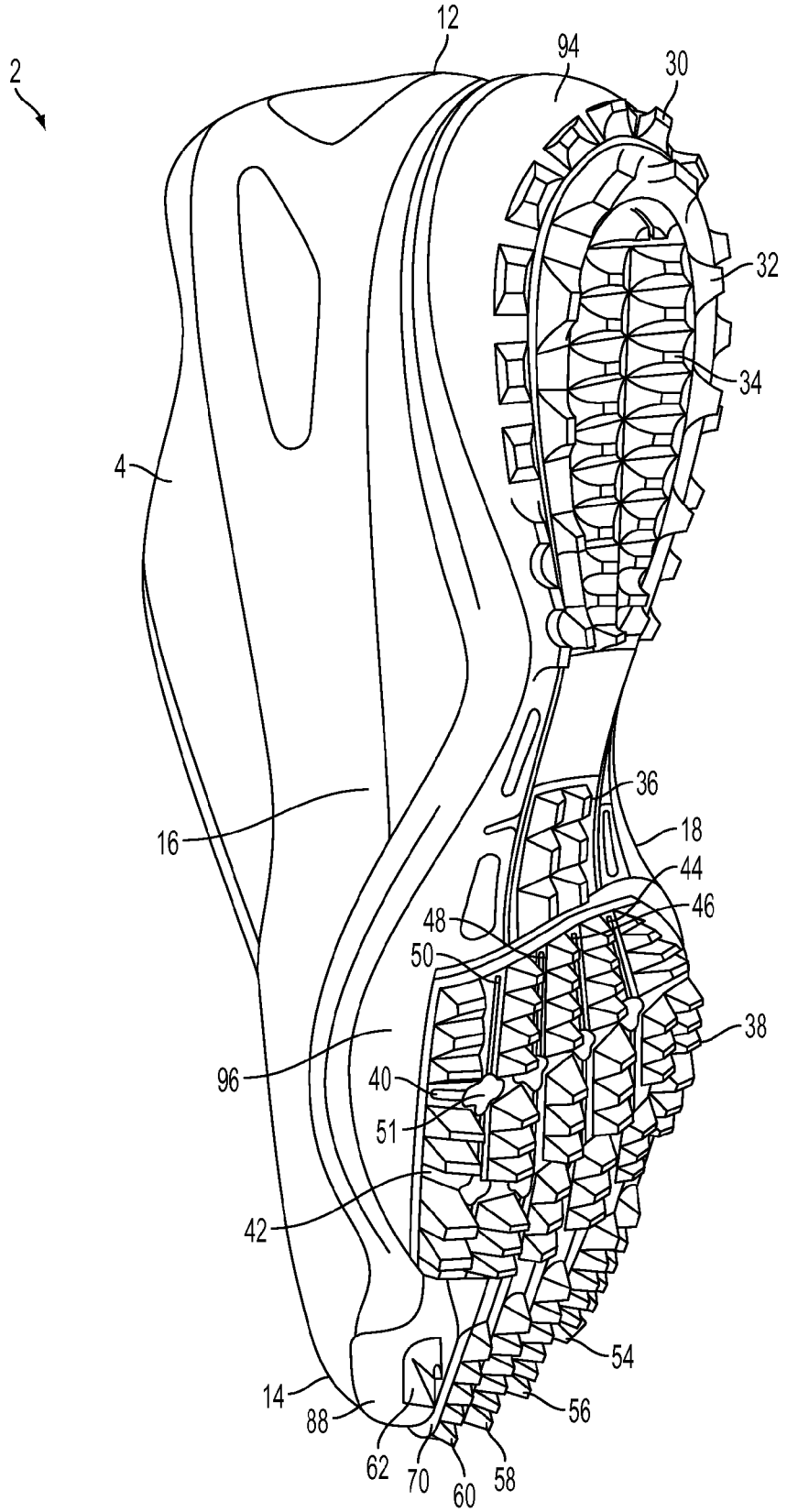
FIG. 3 is a lateral-bottom perspective view of the golf shoe of FIG. 1.

An exemplary golf shoe 2 is shown in FIGS. 1-3. The shoe 2 comprises an upper 6, a midsole 8, and an outsole 10. The shoe 2 has a heel end 12, opposite toe end 14, lateral side 16 and medial side 18.

The shoe 2 is configured to provide a more natural coupling between the golfer's foot and the ground, allowing the foot to have greater freedom of natural anatomical movement while providing enhanced traction and balance. For example, the shoe 2 can comprise a low-profile, oblique toe box that more closely matches the anatomical shape of a golfer's foot, as opposed to conventional golf shoes that have a taller and narrower, more symmetrical, pointed front end more akin to a men's dress shoe. The lower, oblique toe box can allow the golfer's forefoot and toes to splay apart more freely to provide enhanced balance due to the lower, wider front part of the shoe, as opposed to a conventional golf shoe where the front of the foot is tightly constrained in a static, narrow toe box that is raised higher off the ground.

The shoe 2 can also comprise a rounded, non-raised heel region that moves the golfer's foot closer to the ground and allows the golfer's foot to more naturally roll side-to-side throughout the swing. This is very different from conventional golf shoes that have a large, raised, flat-bottomed heel platform like men's dress shoes and do not allow the golfer's foot to roll side-to-side without the entire sole of the shoe hinging up on one side edge and losing traction. The lack of a large, bulky heel platform also helps to reduce the overall weight of the golf shoe 2.

Furthermore, the outsole 10 of the shoe 2 can comprise independent traction zones that correspond to the shape and position of natural traction regions of a golfer's foot, such as below the heel, below the ball of the foot, and below each of the toes. The traction zones on the outsole can be separated by thin, flexible channel regions that allow the traction zones of the outsole to more readily flex relative to one another, just as the joints and soft tissue of a golfer's foot allow the natural traction regions of the foot to dynamically flex relative to one another. This is very different than conventional golf shoes that comprise a flat, rigid forefoot sole that rely on four to six removable spike cleats that are fixed relative to each other and do not correspond to the natural anatomy of the forefoot.

Figure 4:
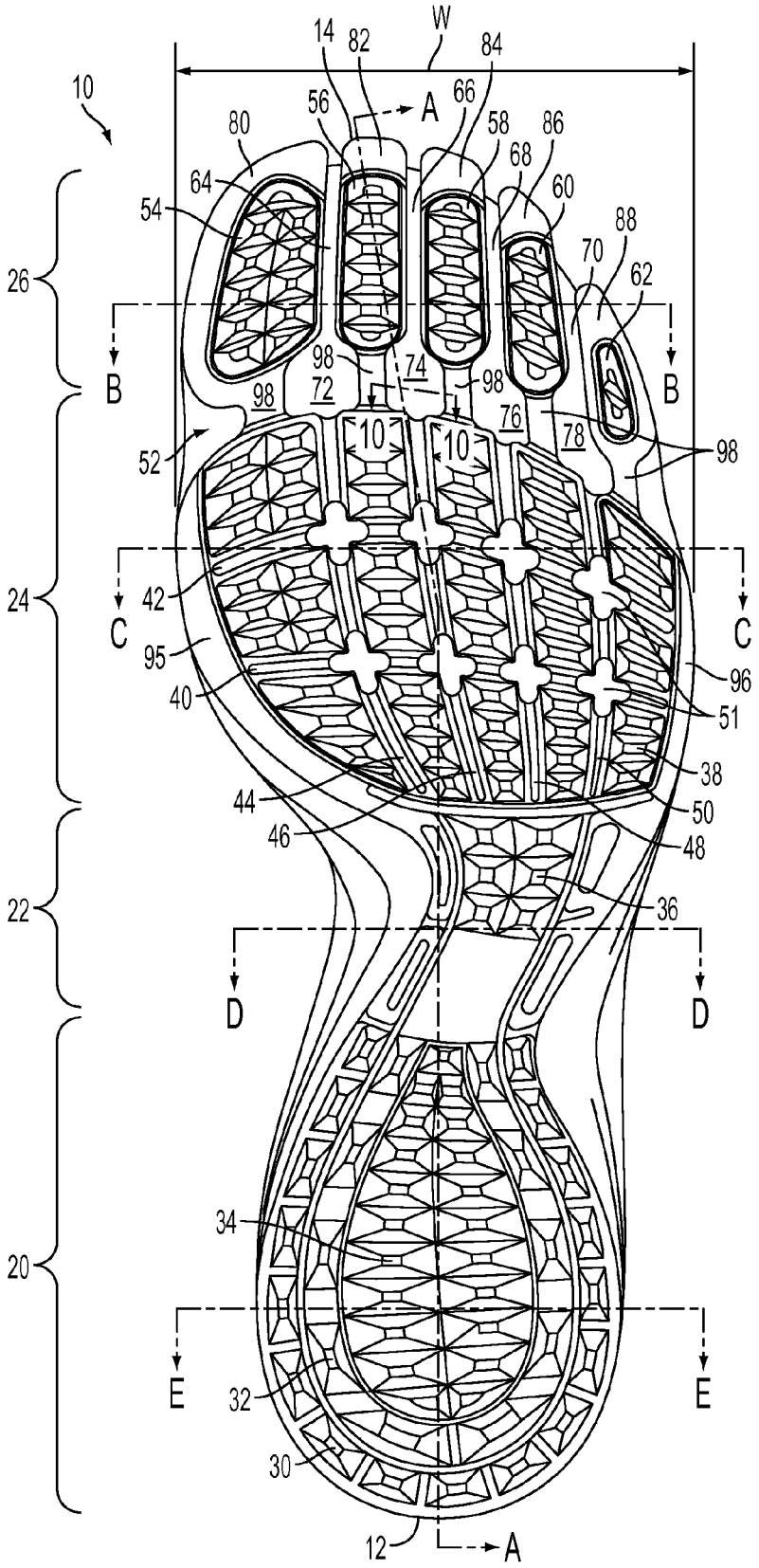
FIG. 4 is a bottom view of an exemplary outsole of the golf shoe of FIG. 1.

As shown in FIG. 4, the outsole 10 can comprise a heel region 20 at the heel end 12, an arch region 22 forward of the heel region, a midfoot region 24 forward of the arch region, and a toe region 26 at the toe end 14. The midfoot region 24 and the toe region 26 are collectively termed the forefoot region of the outsole 10.

Figure 9:
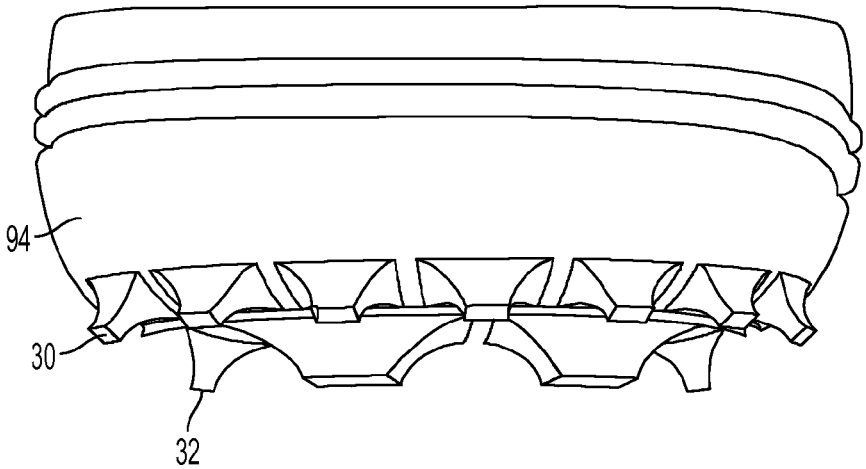
FIG. 9 is a rear view of the outsole of FIG. 4.

As shown in FIGS. 2-4 and 9, the heel region 20 can comprise a generally rounded perimeter 94 extending around the lateral, rear, and medial sides of the heel region. The heel region 20 can further comprise an outer group or row of static traction elements, or cleats, 30 that are aligned along a curvilinear path that extends around medial, rear, and lateral sides of the heel region. As shown in FIGS. 2, 3 and 9, at least some of the outer group of cleats 30 are positioned along the rounded perimeter 94 of the heel region and extend at an angle both radially outwardly and downwardly, such as at about a 30°-45° angle from vertical. This allows the outer group of cleats 30 to maintain traction with flat ground as the foot and the shoe 2 roll medially or laterally during the golf swing or during other movements, such as walking or standing on a slope.

The heel region can further comprise another group or row of cleats 32 that are aligned along a curvilinear path that extends around medial, rear, and lateral sides of the heel region just inside of the outer group of cleats 30. At least a portion of the intermediate group of cleats 32 and a portion of the outer group of cleats 30 can be generally concentric with one another. The intermediate group of cleats 32 can also extend at an angle from vertical, though generally at a smaller angle than the adjacent outer cleats 30. The heel region can further comprise an inner group of cleats 34 positioned at the center of the heel region and within the intermediate group of cleats 32. The inner group 34 can comprise two longitudinal rows of cleats.

The arch region 22 of the outsole 10 can comprise a narrowed neck extending between the wider heel and midfoot regions and configured to be positioned under the arch of the golfer's foot. In contrast to conventional golf shoes that have a heel platform and a raised arch region that does not contact the ground, the arch region 22 can have about the same elevation as the heel region 20 such that the outsole 10 has a continuous lower surface extending from the heel region 20 to the midfoot region 24. The arch region 22 can comprise a traction zone 36 comprising a group of cleats adjacent to the midfoot region 24.

The midfoot region 24 can comprise a broad region of the outsole 10 configured to be positioned generally under the metatarsals and the ball of a golfer's foot. The midfoot region 24 can comprises a large midfoot traction zone 38 that extends across the midfoot region and comprises a plurality of smaller sub-regions each comprising one or more cleats. The midfoot traction zone 38 con be divided into discrete traction sub-regions of generally quadrilateral or trilateral shapes by a plurality of channels that extend across the midfoot region 24. The midfoot region 24 of the outsole 10 can further comprise a rounded medial side 95 and a rounded lateral side 96 that curve upwardly around the medial side 18 and the lateral side 16 of the outer 6, respectively.

The midfoot region 24 can comprise one or more side-to-side channels, such as channels 40 and 42, that extend from the medial side 18 of the outsole to the lateral side 16 of the outsole and divide the midfoot traction zone 38 into two or more rows of traction sub-regions that also extend laterally across the outsole. For example, in the illustrated embodiment, the two lateral channels 40 and 42 divide the midfoot traction zone 38 into three lateral traction sub-regions.

Similarly, the midfoot region 24 can comprise a plurality of longitudinal channels, such as longitudinal channels 44, 46, 48 and 50, that extend from the arch region 22 to the toe region 26 and divide the midfoot traction zone 38 into a plurality of longitudinal rows of traction sub-regions that also extend from the arch region to the toe region. For example, in the illustrated embodiment, the four longitudinal channels 44, 46, 48 and 50 divide the midfoot traction zone 38 into five longitudinal traction sub-regions. Each of these five longitudinal traction sub-regions can be positioned generally under a respective one of the five metatarsals of the golfer's foot, and the four longitudinal channels 44, 46, 48 and 50 can allow the five longitudinal traction sub-regions to flex relative to one another akin to how the golfer's foot allows the five metatarsals to flex relative to one another.

Together, the longitudinal channels (e.g., 44, 46, 48, 50) and the lateral channels (e.g. 40, 42) of the midfoot region 24 can subdivide the midfoot traction zone 38 into a plurality of generally quadrilateral or trilateral traction sub-regions (e.g., 15 such sub-regions in the illustrated embodiment), which can each comprise a plurality of cleats.

At the intersections of the longitudinal channels and the lateral channels, the midfoot region can comprise a plurality of recessed cavities 51, which can be recessed deeper into the outsole that the remainder of the channels. The cavities 51 can be generally cross-shaped, or shaped like a plus sign. Eight such cavities 51 are shown in the illustrated embodiment, one for each intersection of channels in the midfoot region The border between the midfoot region 24 and the toe region 26 of the outsole is defined by a pronounced lateral channel 52 that extends across the outsole from the lateral side 16 to the medial side 18. The channel 52 can be configured to be positioned generally below the metatarsal-phalangeal joints of the golfer's foot, which can allow the outsole 10 to readily bend along the channel 52 when the golfer's foot bends at the metatarsal-phalangeal joints, such as when the back foot goes up on the ball of the foot during the swing follow-through or when the golfer is walking or crouching.

The toe region 26 of the outsole 10 can comprise a plurality of toe portions. The toe portions can be generally longitudinally extending and can correspond generally in shape and location to the position of a golfer's toes within the shoe. The plural toe portions can be separated from one another by longitudinally extending divisions, such as longitudinal channels, that extend from the lateral channel 52 to the toe end 14 of the outsole 10. Furthermore, one or more of the toe portions can comprise a respective toe traction zone having one or more cleats to provide traction beneath the respective toe of the golfer.

For example, as shown in FIGS. 2-8, the exemplary outsole 10 comprises a toe region 26 that includes five toe portions 80, 82, 84, 86, 88 that extend from the lateral channel 52 to the toe end 14 of the outsole. The five toe portions are separated by four longitudinal channels 64, 66, 68, 70 that also extend from the lateral channel 52 to the toe end 14 of the outsole. Each of the five toe portions comprises a respective toe traction zone 54, 56, 58, 60, 62 that each comprises at least two cleats. The big toe traction zone 54 comprises two longitudinal rows of cleats, while the other four toe traction zones 56, 58, 60, 62 each comprise a single longitudinal row of cleats.

The longitudinal channels in the toe region 26 (e.g., channels 64, 66, 68, 70) can be longitudinally aligned with the longitudinal channels in the midfoot region 24 (e.g. channels 44, 46, 48, 50) such that each respective pair of longitudinal channels can cooperate to allow the entire forefoot region of the outsole to more readily bend along each pair of channels. For example, the channel 44 can cooperate with the channel 64 to allow the forefoot region of the outsole 10 to bend along the longitudinal path defined by that pair of channels.

Figure 10:
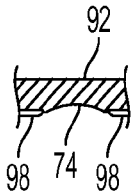
FIG. 10 is a cross-sectional view of a portion the outsole of FIG. 4, taken along line 10-10 of FIG. 4.

The outsole 10 can comprise recessed cavities at one or more of the intersections of the lateral channel 52 with each pair of longitudinal channels in the forefoot region. For example, the outsole 10 can comprise recessed cavities 72, 74, 76, 78 at the intersections of the lateral channel 52 with each pair of longitudinal channels 44/64, 46/66, 48/68, 50/70, respectively. The recessed cavities can be recessed deeper into the outsole relative to other portions of the lateral channel 52. These recessed cavities can allow the outsole to more readily bend along both longitudinal and lateral directions. A cross-sectional view on the cavity 74 is shown in FIG. 10, which also shows the underlying outsole base material 92 and thin strips of outsole material 98 that overly the base material 92 and extend across the lateral channel 52 from each toe portion of the toe region 26 to respective portions of the midfoot traction zone 38.

Figure 8:
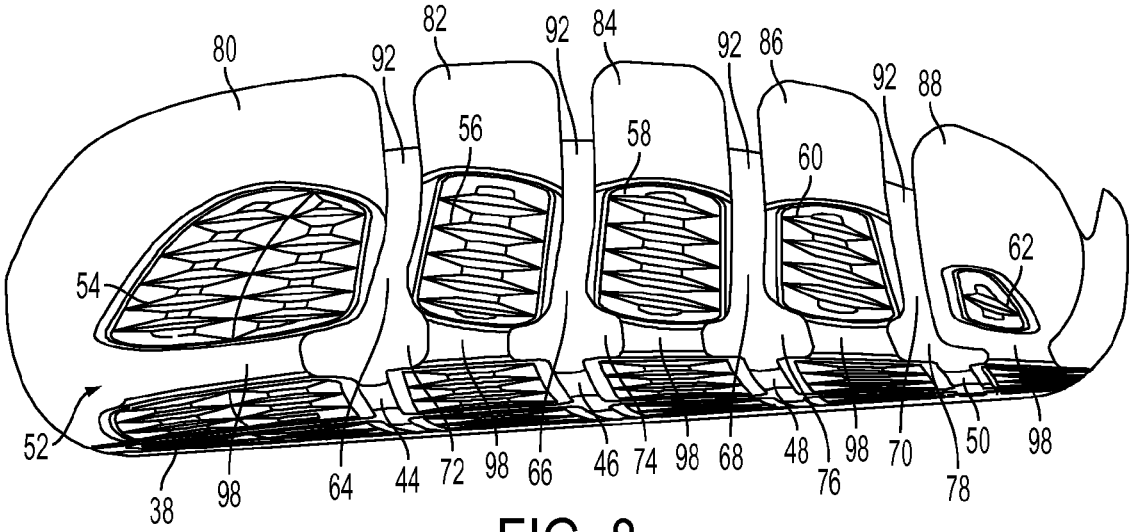
FIG. 8 is a front view of the outsole of FIG. 4.

As shown in FIGS. 1, 4 and 8, the front end portions of the toe portions 80, 82, 84, 86, 88 can extend around the front end of the upper 6 and form the front-most portions of the shoe 2. The base layer 92 of the outsole 10 can terminate just below and rearward of the ends of each of the toe portions 80, 82, 84, 86, 88, and the longitudinal channels 64, 66, 68, 70, which are defined between the toe portions, can extend beyond the forward end of the base layer and along portions of the outer 6 up as far as the toe portions extend. The front end portions of the toe portions and the channels between them on the forward end of the shoe 2 can provide enhanced traction and support when the golfer lifts the rear of the foot all the way up so that only the distal ends of the toes are interacting with the ground, such as with the rear foot at the end of the golf swing, or when the golfer is on a severe uphill lie or climbing a hill.

In some embodiments, various portions of the outsole other than the cleated traction zones can comprise textured surfaces that provide improved traction compared to smooth surfaces. Portions of the outsole that can comprise such textured surfaces can include the individual toe portions 80-88, the lateral and medial sides 95, 96 of the midfoot region 24 adjacent to the midfoot traction zone 38, and the rounded perimeter 94 of the heel region 20.

Figure 5:
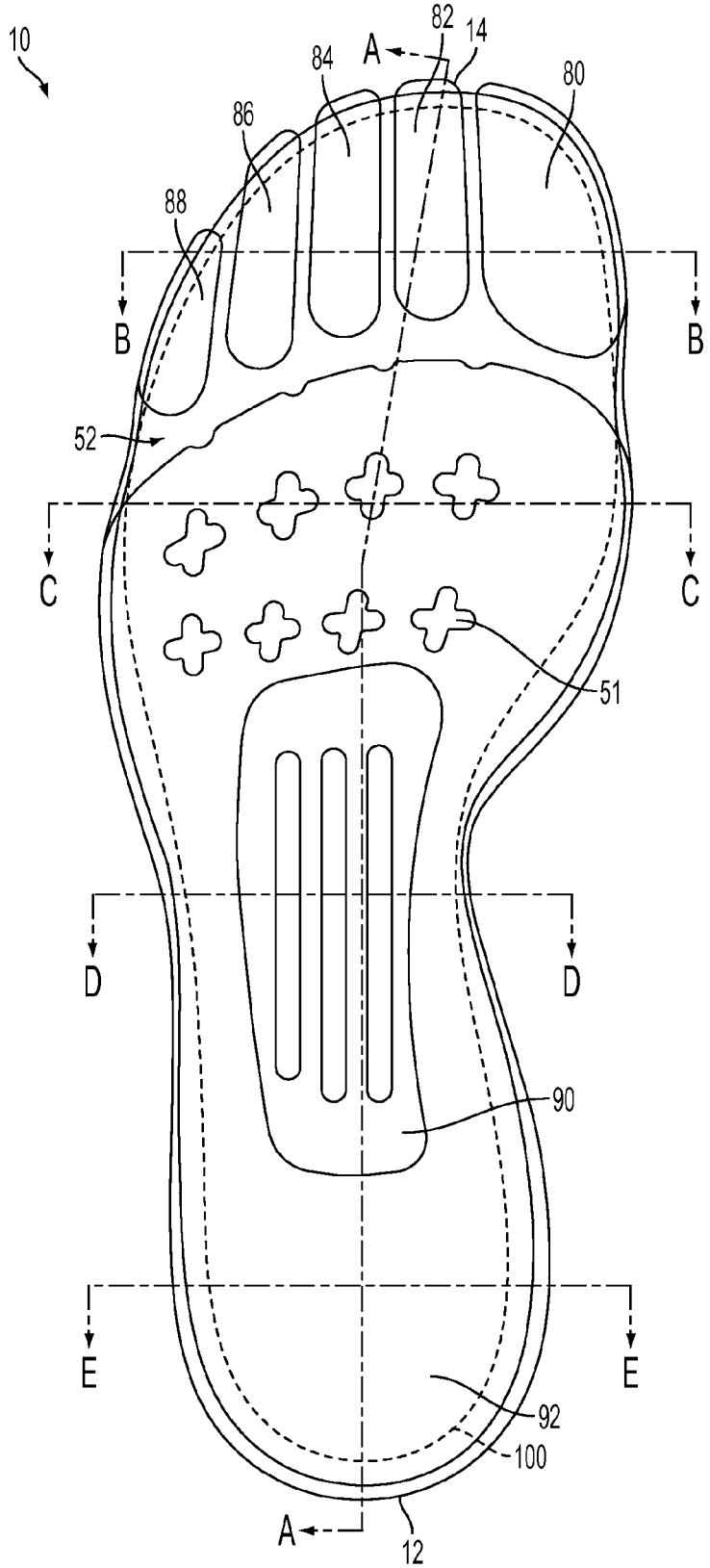
FIG. 5 is a top view of the outsole of FIG. 4.
Figure 11:
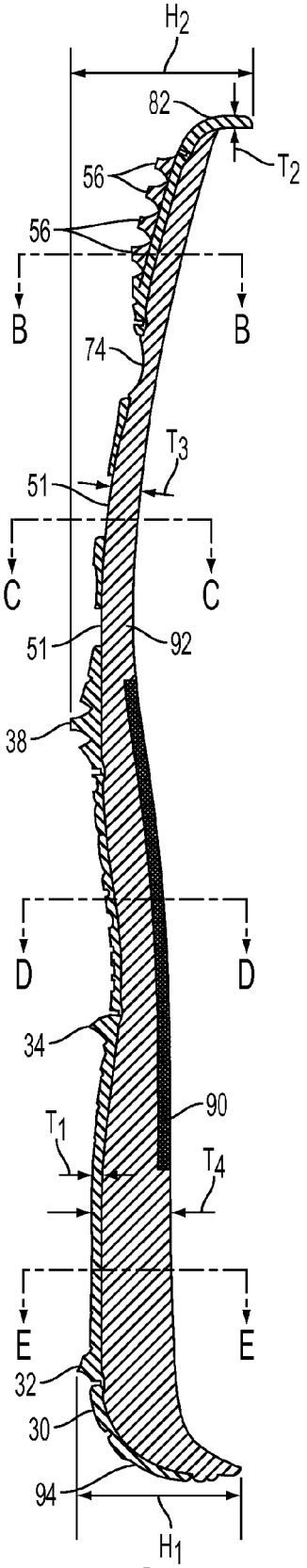
FIG. 11 is a cross-sectional view of the outsole of FIG. 4, taken along line A-A of FIG. 4.

FIG. 5 shows a top view of the outsole 10, showing a support section, or shank, 90 that can be imbedded in the base layer 92 of the outsole. The shank 90 can be generally rectangular and can be made of a semi-rigid material such as nylon. The shank 90 can provide increase torsional rigidity in the arch region of the outsole. The shank 90 is also visible in cross-section in FIG. 11.

Figure 6:
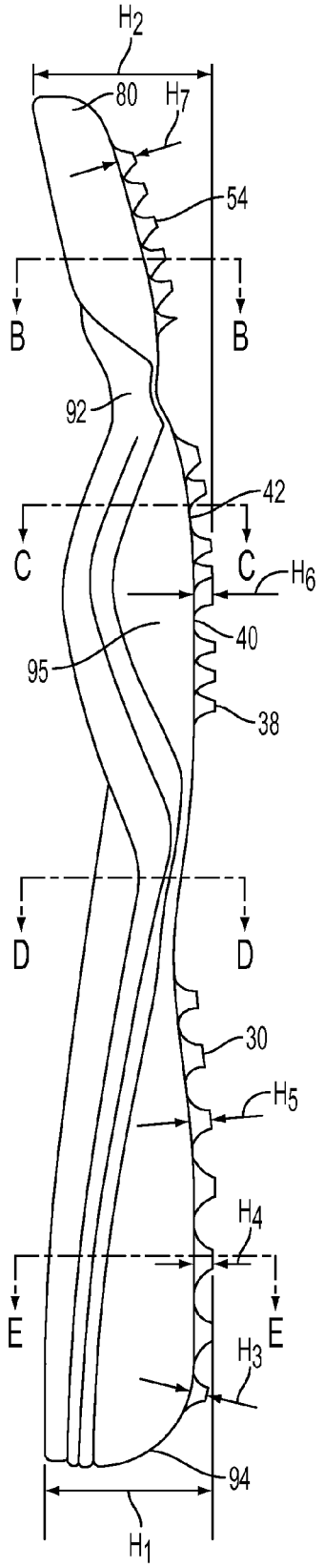
FIG. 6 is a medial side view of the outsole of FIG. 4.
Figure 7:
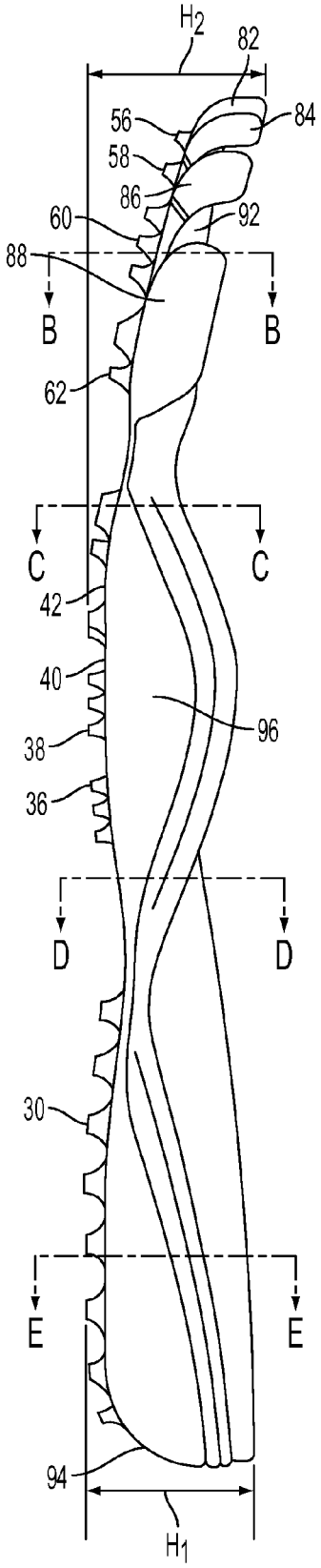
FIG. 7 is a lateral side view of the outsole of FIG. 4.

FIGS. 6 and 7 show medial and lateral views of the outsole 10, respectively. The overall height $H_1$ of the heel region of the outsole 10 can range from about 30-42 mm, and is about 36 mm in the illustrated embodiment. The overall height $H_2$ of the forefoot region of the outsole 10 can range from about 30-45 mm due to the toe portions that extend up along the front of the shoe, and is about 38.5 mm in the illustrated embodiment.

The cleats 30 along the heel region of the outsole can vary in the distances they project from the surface 94. For example, the cleats 30 can vary in height from about 3.0 mm to about 5.0 mm. In the illustrated embodiments, the height $H_3$ of the cleats 30 nearest to the heel end is about 3.5 mm, the height $H_4$ of the next set of the cleats 30 is about 4.0 mm, and the height $H_5$ of the cleats 30 closer to the arch region is about 4.5 mm.

The height $H_6$ of the cleats 38 in the midfoot region can range from about 3.0 mm to about 5.0 mm. In the illustrated embodiment, a majority of the cleats 38 have a height of about 4.5 mm, while the cleats nearest to the lateral side have a height of about 3.5 mm and some of the cleats nearest to the medial side have a height that varies across the cleat from about 4.0 mm to about 4.5 mm. The reduced height of the cleats near the side edges of the midfoot traction zone can allow the shoe 2 to maintain traction with the ground as the shoe rolls to either side during the swing.

The height $H_7$ of the cleats in the toe traction zones 54-62 can range from about 3.0 mm to about 4.5 mm. In the illustrated embodiment, a majority of the cleats in the toe traction zones 54-62 have a height of about 4.0 mm, while some of the cleats nearest to the front end of the shoe have a height of about 3.5 mm. The reduced height of the cleats near the front ends of the toe traction zones can allow the shoe 2 to maintain traction with the ground as the shoe rolls up on the toe, such as during the follow through or while walking uphill.

Figure 12:
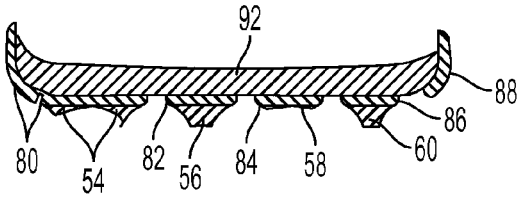
FIG. 12 is a cross-sectional view of the outsole of FIG. 4, taken along line B-B of FIG. 4.
Figure 13:
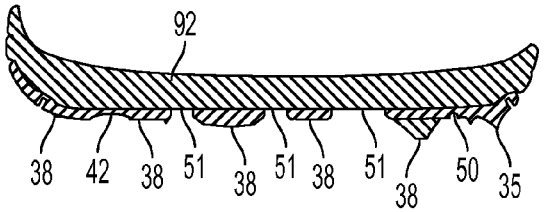
FIG. 13 is a cross-sectional view of the outsole of FIG. 4, taken along line C-C of FIG. 4.
Figure 15:
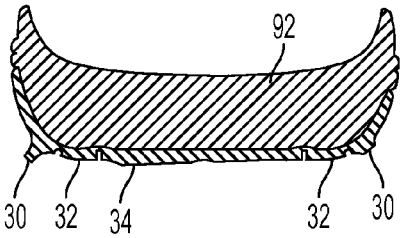
FIG. 15 is a cross-sectional view of the outsole of FIG. 4, taken along line E-E of FIG. 4.

As shown in FIG. 6, the toe portion 80 that corresponds to the golfer's big toe can curl around the medial side of the shoe 2 as well as the front end of the shoe. Similarly, as shown in FIG. 7, the toe portion 88 that corresponds to the golfer's pinky toe can curl around the lateral side of the shoe 2 as well as the front end of the shoe. Along with the rounded medial and lateral sides 95, 96 of the midfoot region and the rounded perimeter 94 of the heel region, the toe portions 80 and 88 can provide enhanced traction when the shoe 2 rolls laterally or medially. This is also illustrated in FIGS. 12, 13 and 15.

FIG. 8 shows a front view of the outsole 10 with the cleats in the toe traction zones 54-62 and the midfoot traction zone 38 shown in a flat, two-dimensional manner for illustrative purposes. However, the cleats realistically extend downwardly from the sole as shown in FIGS. 2, 3, 6 and 7. Similarly, the longitudinal channels 44-50 in the midfoot region, the cross channel 52, and the longitudinal channels 64-70 in the toe region are shown without a depth dimension in FIG. 8 for illustrative purposes. FIG. 8 shows how the toe portions 54-62 extend upwardly past the front edge of the base layer 92 and how the toe portions 80 and 88 curl around the sides of the shoe. FIG. 8 also shows that the outsole 10 generally curves upward moving from the midfoot region toward the front end of the outsole.

FIG. 9 shows a rear view of the outsole 10. As shown, the outer group of cleats 30 can be positioned significantly higher on the outsole 10 than the intermediate group of cleats 32 (and also the inner group of cleats 34). FIG. 9 also illustrates the angle projection directions of the cleats 30 and 32, which allow the shoe to roll medially and laterally, and up on the rear of the heel, while maintaining enhanced contact between the cleats and the ground.

FIGS. 11-15 show cross-sectional views of the outsole along sections lines A-A, B-B, C-C, D-D, and E-E of FIGS. 4-7, respectively. The thickness $T_1$ of the traction zones of the outsole, from the base of the cleats to the base layer 92, can range from about 1.0 mm to about 2.0 mm. The thickness $T_2$ of the toe portions 80-88 can range from about 1.5 mm to about 3.0 mm. The thickness $T_3$ of the base layer can range from about 3.0 mm in the cavities 51 and 72-78 of the forefoot region to about 17 mm in the heel region. The overall thickness $T_4$ of the outsole 10 can range from about 2.0 mm in the recessed cavities 51 and 72-78, to about 20 mm in the heel region (not including the height of the cleats).

The cleats of the outsole 10 can comprise lug style cleats that are an integral extension of the platform underlying them and are formed as part of the outsole molding process. While the lug cleats 38 may elastically deform to a small degree, they may not have substantial dynamic flexion properties comparable to removable dynamic spike cleats that are typically found on conventional golf shoes. The lug cleats can have a frusto-pyramidal shape and can be directionally oriented and/or aligned in rows or columns to provide increased traction and resistance in certain directions (such as the heel-toe directions) and relatively less resistance in other directions. In the illustrated embodiment, the outsole 10 has no removable cleats, and relies on the numerous lug cleats dispersed on the various traction zones of the outsole. The lack of bulky removable spike cleats and the necessary receptacle structures in the outsole can help reduce the overall weight of the golf shoe 2.

Figure 16:
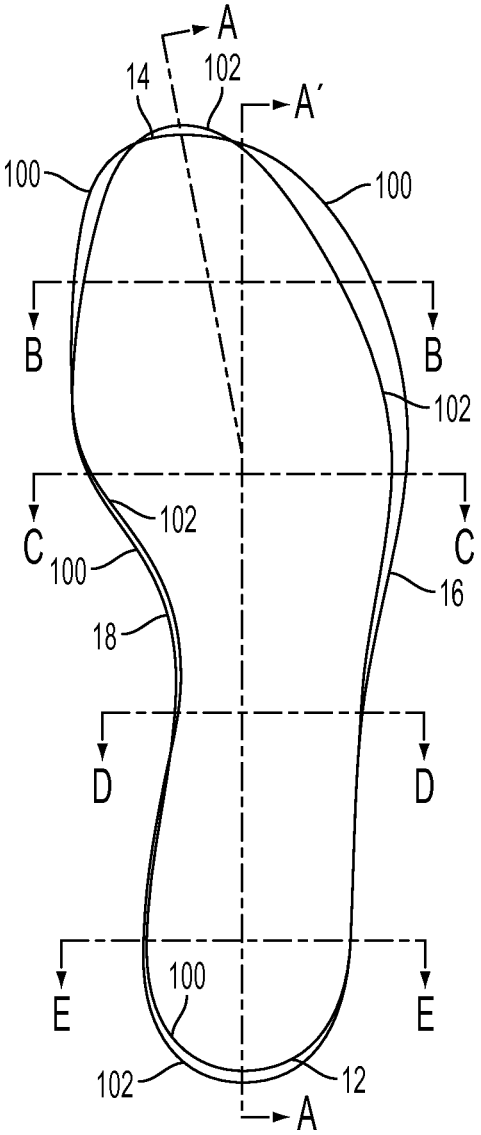
FIG. 16 is a top view of two outer perimeters of lasts for golf shoes.
Figure 17:
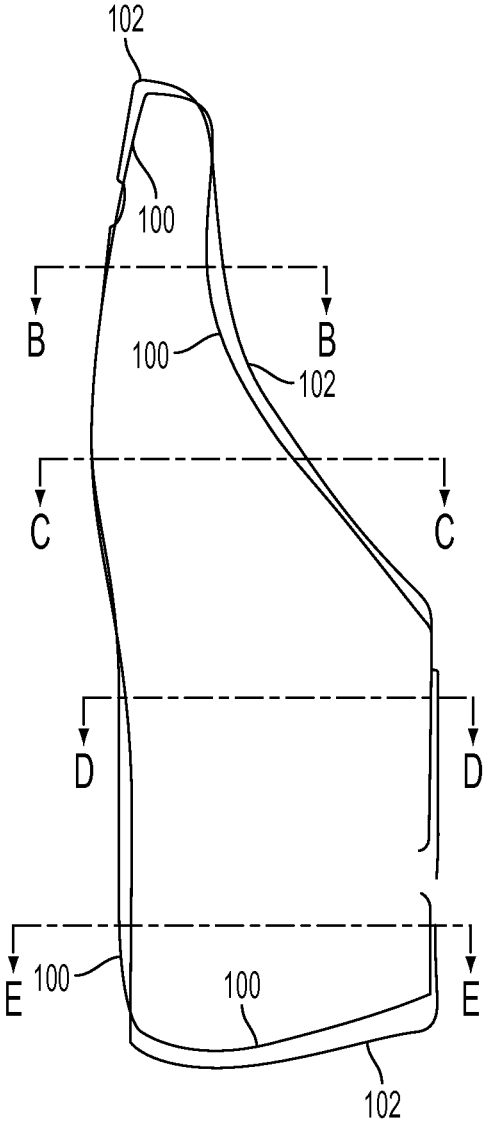
FIG. 17 is a side view of the two lasts of FIG. 16.

FIGS. 16 and 17 show outlines of a last 100 that can be used to from the shoe 2 around. The last 100 can comprise a rigid object that closely simulates the natural shape of a bare foot. The outlines of the last 100 are shown in comparison to a conventional last 102 that has a narrower, elongated and taller shape like a men's dress shoe. The conventional last 102 is designed more for aesthetics and style, as are conventional golf shoes, having excess space in the tip of the toe 14 and the heel 12, and being overly cramped on the lateral and medial sides 16, 18. FIGS. 18-21 show cross-sectional outlines of the lasts 100 and 102 along lines B-B, C-C, D-D, and E-E, respectively, of FIGS. 16 and 17.

The internal open regions of a golf shoe are generally shaped around the shape of a last and the golf shoe 2 can have an inner open region that is similar in shape to the last 100. The toe box portion of the inner open region of the shoe 2 can be significantly wider than in a conventional golf shoe. For example, the width of the last 100 at line B-B in FIG. 16 can be about 10% to about 30% greater than the width of a conventional last 102. In the illustrated embodiment, the width of the last 100 at line B-B, and the width of the toe box at a corresponding location of the shoe 2, can be greater than 80 mm, greater than 85 mm, greater than 90 mm and/or greater than 95 mm. Similarly, the width the last 100 at line C-C in FIG. 16 can be about 5% to about 15% greater than the width of a conventional last 102. In the illustrated embodiment, the width of the last 100 at line C-C, and thus the width of the inner open region of the shoe 2 at a corresponding location, can be greater than 85 mm, greater than 90 mm, greater than 95 mm, greater than 100 mm, and/or greater than 105 mm. This increased width of the forward portion of the last is also shown in FIGS. 18 and 19.

Figure 20:
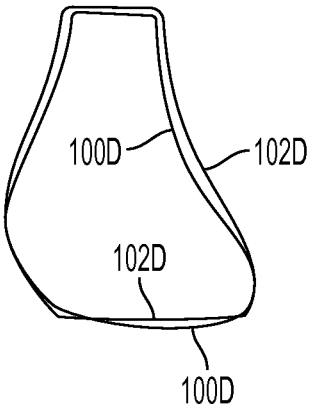
FIG. 20 is another cross-sectional view of the two lasts of FIG. 16, taken along line D-D of FIG. 16.

The width of the arch region of the last 100 at line D-D in FIG. 16 can be about the same as the width of a conventional last 102. This is also shown in FIG. 20. However, the width of the heel region of the last 100 at line E-E in FIG. 16 can be narrower than the width of the conventional last 102 by about 1% to about 10%. This is also shown in FIG. 21.

Figure 18:
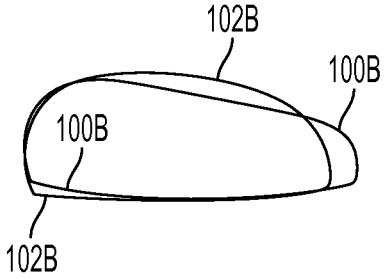
FIG. 18 is a cross-sectional view of the two lasts of FIG. 16, taken along line B-B of FIG. 16.
Figure 19:
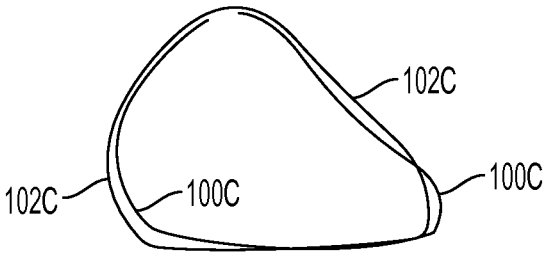
FIG. 19 is another cross-sectional view of the two lasts of FIG. 16, taken along line C-C of FIG. 16.

The height of the last 100 can be shorter than the height of the conventional last 102 at the forward portions of the last, such as shown in FIGS. 18 and 19. For example, the height of the last 100 at the intersection of the line B-B and A-A can be about 10% to about 30% less than the height of the conventional last 102. In some embodiments, the height of the last 100 at the intersection of the line B-B and A-A can be less than 40 mm, less than 35 mm, less than 30 mm, less than 25 mm and/or less than 20 mm. 3

Figure 21:
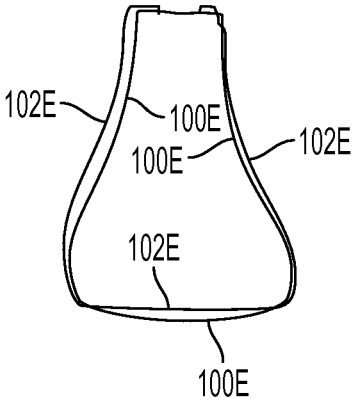
FIG. 21 is another cross-sectional view of the two lasts of FIG. 16, taken along line E-E of FIG. 16.

The arch and heel portions of the last 100, as shown in FIGS. 17, 20 and 21, have about the same overall height as a conventional last 102, but can be narrower and lower to the ground than a conventional last 102. While a conventional last 102 has a substantially flat, squared lower surface in these regions, the last 100 can have a more rounded, non-squared lower surface in the arch and heel regions.

The heel-toe length of the last 100 along line A-A in FIG. 16 can be about 5% to about 15% shorter than the length of a conventional last 102 along line A-A. In some embodiments, the heel-toe length of the last 100 along line A-A in FIG. 16 can be less than 260 mm, less than 265 mm, less than 270 mm, less than 275 mm, less than 280 mm, and/or less than 285 mm.

The ratio of the width of the last 100 at line B-B divided by the heel-toe length of the last 100 along line A-A can be greater than 0.28, greater than 0.29, greater than 0.30, greater than 0.31, greater than 0.32, greater than 0.33, and/or greater than 0.34.

Similarly, the ratio of the width of the last 100 at line C-C divided by the heel-toe length of the last 100 along line A-A can be greater than 0.28, greater than 0.29, greater than 0.30, greater than 0.31, greater than 0.32, greater than 0.33, and/or greater than 0.34.

The ratio of the maximum width of the toe box of the internal open region of the shoe 2 divided by the maximum heel-to-toe length of the internal open region of the shoe 2 can be greater than in a conventional golf shoe, such as greater than 0.33, greater than 0.34, greater than about 0.35, greater than 0.36, and/or greater than 0.37.

The radius of curvature, in a horizontal plane (when the shoe is resting on a horizontal surface), of the frontmost point (e.g., along the line A-A of FIG. 16) of the toe box of the internal open region of the golf shoe 2 can be larger than in a conventional golf shoe, such as greater than 15 mm, greater than 20 mm, greater than 25 mm, greater than 30 mm, and/or greater than 40 mm.

Figure 14:
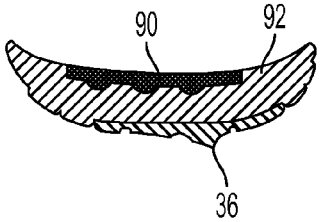
FIG. 14 is a cross-sectional view of the outsole of FIG. 4, taken along line D-D of FIG. 4.

For the golf shoe 2, the width of the outsole 10 in the midfoot region 24 is relatively large compared to the narrower arch region 22. In particular, the portion of the midfoot region 24 that is configured to contact the ground extends from the medial side of the rounded medial side 95 to the lateral side of the rounded lateral side 96. The maximum width W between the medial side of the rounded medial side 95 to the lateral side of the rounded lateral side 96 is shown in FIG. 4. However, in the arch region 22, the minimum width between the medial side of the rounded medial side 95 to the lateral side of the rounded lateral side 96 is much smaller. This minimum width in the arch region is illustrated in FIG. 14 by the width of the traction region 36 that has hatching lines that slope down and to the right. In some embodiments of the shoe 2, the ratio of the maximum width W in the midfoot region divided by the minimum width of the of the traction region 36 in the arch region can be greater than 2.5, greater than 2.6, greater than 2.7, greater than 2.8., greater than 2.9, and/or greater than 3.0.

Note that all of the absolute measurements of the lasts and shoes disclosed herein are based on a standard men's size 9 (U.S.) golf shoe. However, proportionally scaled measurements correspondingly apply to other shoe sizes.

The golf shoe 2 can help reduce stress on a golfer's ankle, knee, hip, and back joints because the golf shoe 2 allows the joints in the golfer's foot to have greater range of motion and more freedom to adapt during golf motions, and because the outsole 10 features rounded perimeter edges that allow the shoe to more readily roll side-to-side and front-to-back. In contrast, a conventional golf shoe has a flat, rigid sole and a constrained toe box that locks the golfer's foot is a stationary position and thereby transfers all the torque and stress generated during the golf swing away from the joints of the foot and up to the ankle, knee, hip and back joints. Thus, the golf shoe 2 can help prevent injuries to a golfer's joints by providing more freedom for the foot to move naturally during golf actions.

In addition, because the shoe 2 encourages the golfer's foot to become more active and dynamic during golf actions, the muscles of the golfer's foot are trained over time to become stronger and more coordinated, further enhancing the golfer's ability to balance and stabilize through the swing, and increasing torque generation during the swing, ultimately resulting in greater club speed and improved accuracy.

The outsole 10 may be formed in any one of a number of conventional methods, including one or more injection molding steps and compression molding. Once formed, the outsole 10 can then be attached to the upper 6 in a conventional manner. In some embodiments, a cushioning midsole portion 8 can also be included between the outsole and the upper.

The cushioning midsole 8 can be formed from a variety of materials known in the art, including ethyl vinyl acetate (EPA) or blown thermoplastic polyurethane (TPU), or blown thermoplastic polyurea (TPUA). Other suitable materials include both natural and synthetic rubbers, such as cis-1,4-polybutadiene, trans-1,4-polybutadiene, 1,2-polybutadiene, cis-polyisoprene, trans-polyisoprene, polychloroprene, polybutylene, the styrenic block copolymers such as styrene-butadiene-styrene (SBS), styrene-ethylene-butylene-styrene, (SEBS) and styrene-ethylenepropylene-styrene (SEPS), (commercial examples include SEPTON marketed by Kuraray Company of Kurashiki, Japan; TOPRENE by Kumho Petrochemical Co., Ltd and KRATON marketed by Kraton Polymers).

The outsole 10 may be made formed from a variety of materials known in the art, including polyurethane (PU), polyurea (PUA) (especially thermoplastic polyurethane (TPU) and thermoplastic polyurea (TPUA)), ethyl vinyl acetate (EVA) nylon, carbon fiber, glass fiber, polyaramid (generally designated in the art as an aromatic polycarbonamide) which include those commercially available under the tradenames Kevlar® (E.I. du Pont de Nemours and Company), Twaron® (Akzo Nobel), Technora (Teijin), Nomex® and Nomex Z200 (E.I. du Pont de Nemours and Company), Teijinconex (Teijin), and Apial (Unitika). Other suitable materials include both natural and synthetic rubbers, such as cis-1,4-polybutadiene, trans-1,4-polybutadiene, 1,2-polybutadiene, cis-polyisoprene, trans-polyisoprene, polychloroprene, polybutylene, the styrenic block copolymers such as styrene-butadiene-styrene (SBS), styrene-ethylene-butylene-styrene, (SEBS) and styrene-ethylenepropylene-styrene (SEPS), (commercial examples include SEPTON marketed by Kuraray Company of Kurashiki, Japan; TOPRENE by Kumho Petrochemical Co., Ltd and KRATON marketed by Kraton Polymers). Other suitable materials include the amide block copolymers and ester block copolyethers. The amide block copolymers (PEBA) are well known under the trademark PEBAX® commercialized by ATOCHEM. The ester block polyethers (PEBE) include products that have a rigid phase of the terephtalate polybutadiene type (PBT). These are known under the trademark HYTREL® (E.I. du Pont de Nemours and Company) or ARNITEL® (AKZO).

It will be appreciated that the principles and embodiments disclosed herein have application to other types of athletic shoes/outsoles that are subject to dynamic loading and weight shift and require outstanding traction, especially athletic shoes used on grass surfaces.

In view of the many possible embodiments to which the principles of the disclosed technology may be applied, it should be recognized that the illustrated embodiments are only preferred examples of the technology and should not be taken as limiting the scope of the disclosure. Rather, the scope of the disclosure is defined by the following claims. We therefore claim as our invention all that comes within the scope and spirit of these claims.

We claim:

1. A golf shoe outsole comprising:

a heel region;

an arch region forward of the heel region; and a forefoot region forward of the arch region, wherein the forefoot region comprises:

a cross channel extending across the outsole from a medial side of the forefoot region to a lateral side of the forefoot region; and four longitudinal channels extending across the forefoot region from the arch region to a front end of the outsole, the longitudinal channels intersecting the cross channel;

wherein the cross channel comprises recessed cavities at intersections of the cross channel with the longitudinal channels, the recessed cavities being recessed deeper into the outsole than a remainder the cross channel.

2. The outsole of claim 1, further comprising two additional cross channels extending across the outsole from the medial side of the forefoot region to the lateral side of the forefoot region, the two additional cross channels intersecting the longitudinal channels.

3. The outsole of claim 1, wherein the four longitudinal channels divide the forefoot into five forefoot traction portions, and wherein each of the five forefoot traction portions is configured to be positioned generally under a respective one of a person's metatarsals.

4. The outsole of claim 1, wherein the forefoot region further comprises five toe traction portions positioned forward of the cross channel and separated from one another by the four longitudinal channels.

5. The golf shoe outsole of claim 1, wherein the forefoot region comprises:

a midfoot region forward of the arch region and configured to be positioned under metatarsals of a wearer's foot; and a toe region forward of the midfoot region, the toe region comprising a plurality of toe traction zones separated from one another by a plurality of toe channels that extend in a heel-toe direction, the toe traction zones comprising at least one cleat and being configured to be positioned under respective toes of a wearer's foot.

6. The golf shoe outsole of claim 5, wherein each of the toe traction zones comprise two or more cleats.

7. The golf shoe outsole of claim 5, wherein each of the toe traction zones comprises a toe base pad and at least one cleat extending from the toe pad, and wherein the toe base pads and the toe channels extend around a front end of the golf shoe and are visible from a top-down view of the golf shoe when the show is resting on a flat surface.

8. The golf shoe outsole of claim 1, wherein the heel region comprises:

an outer group of cleats arranged around a perimeter of the heel region;

an inner group of cleats arranged within the outer group of cleats; and an intermediate group of cleats arranged within the outer group of cleats and around the inner group of cleats.

9. The golf shoe outsole of claim 8, wherein the perimeter of the heel region is rounded in a horizontal plane and rounded in vertical planes, and wherein the outer group of cleats project from the rounded perimeter in radially outward and downward directions.

10. The golf shoe outsole of claim 8, wherein the outer group of cleats are aligned along a curvilinear path that extends around medial, rear, and lateral sides of the heel region.

11. The golf shoe outsole of claim 8, wherein the intermediate group of cleats are aligned along a curvilinear path that extends around medial, rear, and lateral sides of the inner group of cleats.

12. The golf shoe outsole of claim 1, wherein the outsole does not comprise removable traction elements.

13. The golf shoe outsole of claim 1, wherein the arch region comprises a plurality of cleats.

* * * * *